United States Patent [19]

Hurlebaus et al.

[11] Patent Number: 4,674,663

[45] Date of Patent: Jun. 23, 1987

[54] ARRANGEMENT FOR SHAPING HOSIERY ARTICLES

[75] Inventors: Heinz A. Hurlebaus, Weilheim-Teck; Werner Müller, Heiningen, both of Fed. Rep. of Germany

[73] Assignee: August Krempel Söhne GmbH & Co. KG, Stuttgart, Fed. Rep. of Germany

[21] Appl. No.: 877,022

[22] Filed: Jun. 20, 1986

[30] Foreign Application Priority Data

Jul. 16, 1985 [DE] Fed. Rep. of Germany ..... 3525327

[51] Int. Cl.[4] ..... D06C 5/00

[52] U.S. Cl. ..... 223/1; 223/75; 223/112

[58] Field of Search ..... 223/75, 76, 77, 112, 223/1

[56] References Cited

U.S. PATENT DOCUMENTS

| | | | |
|---|---|---|---|
| 2,852,171 | 9/1958 | Owens | 223/1 |
| 2,857,085 | 10/1958 | Bowman et al. | 223/1 |
| 2,905,366 | 9/1959 | Shoaf | 223/1 |
| 2,925,693 | 2/1960 | Boone | 223/1 X |
| 3,095,770 | 7/1963 | Garrou | 223/75 X |

*Primary Examiner*—Louis K. Rimrodt

*Attorney, Agent, or Firm*—Erwin S. Teltscher

[57] ABSTRACT

A shaping machine which is provided for the shaping of panty hose and other hosiery articles includes two substantially vertically extending elongated blades. A motor driven belt drive extends along each of the longitudinal lateral edges of the blades. Each of these belt drives includes at least one endless belt which has a run that projects beyond the blades in such a manner that the contour of this belt run delimits the contour of the blades at their longitudinal sides. The directions of movement of the belt drives are chosen in such a manner that the outer runs of the respective belts move upwardly in the pulling-on position of the blades and downwardly in the pulling-off positions of the blades. The front one of the blades additionally includes a holding arrangement for insert sheets, the holding arrangement being supplied with the insert sheets by a supply device which is arranged laterally next to the blades on the machine frame. The supply device includes a stack magazine, a conveying arrangement including an endless conveyor, and a suction device which is swingable to and fro about a horizontal axis and effects individual withdrawal of the insert sheets from the stack magazine and their transfer to the conveying arrangement.

14 Claims, 5 Drawing Figures

ARRANGEMENT FOR SHAPING HOSIERY ARTICLES

BACKGROUND OF THE INVENTION

The present invention relates to hosiery manufacturing machinery in general, and more particularly to arrangements for shaping hosiery articles, especially panty hose.

There are already known various constructions of hosiery shaping arrangements of the type here under consideration, among them such which include at least one elongated flat blade and two belt drives each of which is arranged at one of the longitudinal sides of the blade and which include respective driving belts that are guided within the contour of the blade, these belt drives being driven in such a manner that the driving belts thereof move in opposite directions and perform pulling-on and pulling-off operations on the hosiery articles.

Arrangements of this type are used for stretching and ironing unshaped hosiery articles, especially panty hose or other hose or stockings, and for shaping such articles over their entire lengths so as to be ready for packaging. To achieve this, a single shaping blade is needed for stockings and similar hose, while two shaping blades which are arranged one behind the other or offset with respect to each other are needed for panty hose.

An arrangement of this type is known, for example, from the German patent DE-PS 23 02 758. In this known arrangement, belt drives are arranged at both longitudinal sides of the shaping blades, these belt drives including respective belts which are driven in opposite directions and which are guided within the blade contour. Herein, the directions of movement of the belts of the two belt drives are so chosen that the outer runs of the belts move upwardly in a pulling-on position and downwardly in a pulling-off position of the blades. It is merely necessary for the operating personnel to pull the hose or the respective panty hose leg over the lower end of the associated blade. As soon as the upper edge portion of the hose or of the panty hose leg comes into contact with the upwardly moving outer run of the respective belt, there automatically follows the pulling-on of the hose or leg onto the associated blade. A light barrier which is adjustable to different hose or panty hose lengths then interrupts the upward movement of the belts.

After the pulling-on operation has been completed, the blades are pivoted about a horizontal axis located at the upper regions of the blades for entering a transporting and ironing arrangement which includes heated endless belts. Shaping and ejecting plates which are arranged on the blades are extended downwardly and thus shape the foot region or tip of the respective hose or panty hose leg. During the subsequent retraction of the shaping and ejecting plates, the rollers of the ironing belts are closed and thus fix the positions of the hose or panty hose leg tips. Then, the following pulling-off operation is assisted by the change in the direction of movement of the belts. After the pulling-off operation has been completed, the blades are pivoted back into their original positions and thus they are ready for the next following pulling-on operation.

Now, experience has shown that, for a better presentation of the hosiery article in its package, it is often desired to arrange insert sheets in one of the stockings or hose of the pair, or in one of the legs of the panty hose. This is particularly true when the hosiery articles are provided with patterns, since such patterns are properly displayed or become recognized through the package window only due to a contrast effect with the background presented by the insert sheet. Yet, the known hosiery shaping arrangements of the above-discussed type are not equipped for the insertion of such insert sheets.

SUMMARY OF THE INVENTION

Accordingly, it is a general object of the present invention to avoid the disadvantages of the prior art.

More particularly, it is an object of the present invention to improve the hosiery shaping arrangement of the type here under consideration in such a manner as to provide for an automatic or semiautomatic insertion of insert sheets into the hose or into the panty hose leg.

Still another object of the present invention is to develop an insert sheet introduction arrangement of the above type which is relatively simple in construction, inexpensive to manufacture, easy to install and use, and reliable in operation.

In keeping with these objects and others which will become apparent hereafter, one feature of the present invention resides in an arrangement for shaping hosiery articles, this arrangement comprising at least one elongated flat blade having a wide side and two longitudinal sides; two belt drives including respective driving belts which are guided within the contour of the blade and each arranged at one of the longitudinal sides of the blade; means for driving the belt drives such that the driving belts thereof move in opposite directions and perform pulling-on and pulling-off operations on the hosiery articles; means for supplying insert sheets sequentially prior to each pulling-on operation to a holding location arranged at the wide side of the blade; and holding means situated at the holding location within the contour of the blade for receiving the insert sheets from the supplying means and temporarily holding such insert sheets, including means for transferring the insert sheets during the respective pulling-off operations into the interiors of the respective hosiery articles.

The present invention is based on the idea that a holding arrangement is to be provided at the wide side of the respective blade within the contour of the blade, that an individual insert sheet is to be supplied to this holding arrangement from the outside prior to each pulling-on operation, that the insert sheet held in the holding arrangement becomes situated in the interior of the respective hose or panty hose leg during the performance of the pulling-on operation, and that this insert sheet is then pulled off from the blade together with the affected hose or panty hose leg during the pulling-off operation.

It is advantageous when the transferring means includes an ejector slide which is activated during the pulling-off operation, moves relative to the blade during the pulling-off operation at a speed corresponding to the pulling-off speed, and engages a trailing edge of the insert sheet as considered in the direction of ejection of the latter.

According to another advantageous aspect of the present invention, the holding means includes two guide rails which face one another, are open toward the supplying means, extend in the longitudinal direction of the blade, and overlap the longitudinal lateral edges of the respective insert sheets, and abutment means for the leading edge of the respective insert sheet, including at least one end abutment arranged at the ends of the guide rails and being retractable from the path of movement of the respective insert sheet during the pulling-off operation. The abutment means advantageously includes a mounting lever pivotably mounted on the blade and carrying the end abutment at one end portion thereof, and means for urging the lever toward one end position thereof in which the end abutment projects into the path of movement of the leading edge of the respective insert sheet. There is then further provided means for pivoting the lever during the pulling-off operation against the force of the urging means into another end position in which the end abutment is retracted from the path. Advantageously, the blade includes a wide side cover provided with at least one opening and the end abutment extends through the opening at least in the one end position of the lever. The lever is advantageously constructed as a two-armed lever.

It is further advantageous when the transferring means includes an ejector slide, when at least one hosiery ejection component is slidably arranged on the blade, and when the pivoting means includes at least one control rod which is arranged within the blade and has a free end, a wedge-shaped control cam mounted on the free end of the control rod and engaging the one end portion of the lever, and means for moving the control rod jointly with the ejector slide and the hosiery ejection component. It is especially advantageous in this connection when the lever with the end abutment and the control rod of the abutment means constitute an abutment unit, and when the abutment means further includes an additional abutment unit similar to the abutment unit and arranged at a spacing transversely of the wide side of the blade therefrom, and the moving means also moves the additional unit.

Advantageously, the holding means has a substantially vertical orientation and the supplying means is so constructed as to supply the insert sheets into the holding means from above at an acute angle with respect to the wide side of the blade. It is currently preferred when the supplying means is operative for supplying the insert sheets into the holding means in free fall. The supplying means advantageously includes sheet dispensing means for automatically introducing the insert sheets into the holding means, such dispensing means including a magazine for the insert sheets, means for individually and sequentially withdrawing the insert sheets from the magazine, and conveying means receiving the individual insert sheets in sequence from the withdrawing means and leading to the holding means of the blade at an acute angle with respect to the wide side of the blade.

It is also proposed by the present invention for the blade to extend substantially vertically and for the dispensing means inclusive of the magazine to be arranged at an upper region laterally next to the blade. Then, the conveying means advantageously includes an endless conveyor, a horizontal conveying path into which the withdrawing means delivers the insert sheets from above in a position in which the respective insert sheet stands on and is aligned on a longitudinal lateral edge thereof, and a discharging path into which the horizontal path gradually merges in the conveying direction and which extends from the horizontal path at an angle of about 90° and downwardly toward the holding means. It is advantageous for the endless conveyor to include a conveyor chain. The endless conveyor may include at least two entraining bosses which engage the respective insert sheets at their trailing edges as considered in the conveying direction, and there is further provided means for intermittently operating the endless conveyor jointly with the withdrawing means in synchronism with the pulling-on and pulling-off operations.

According to another advantageous aspect of the present invention, the withdrawing means includes at least one suction element which is mounted for swinging to and fro between the magazine and an input location situated upwardly of the horizontal path and has suction applied thereto on an intermittent basis, and there is further provided means for swinging the suction element in synchronism with the operation of the endless conveyor from a common drive. Last but not least, the end of the discharging path which is remote from the horizontal path is arranged at a distance which forms an intermediate space from the blade when the latter is in the pulling-on position thereof.

BRIEF DESCRIPTION OF THE DRAWING

The present invention will be explained in more detail below with reference to the accompanying drawing, in which.

DETAILED DESCRIPTION OF THE PREFERRED EMBODIMENT

Figure 1A:
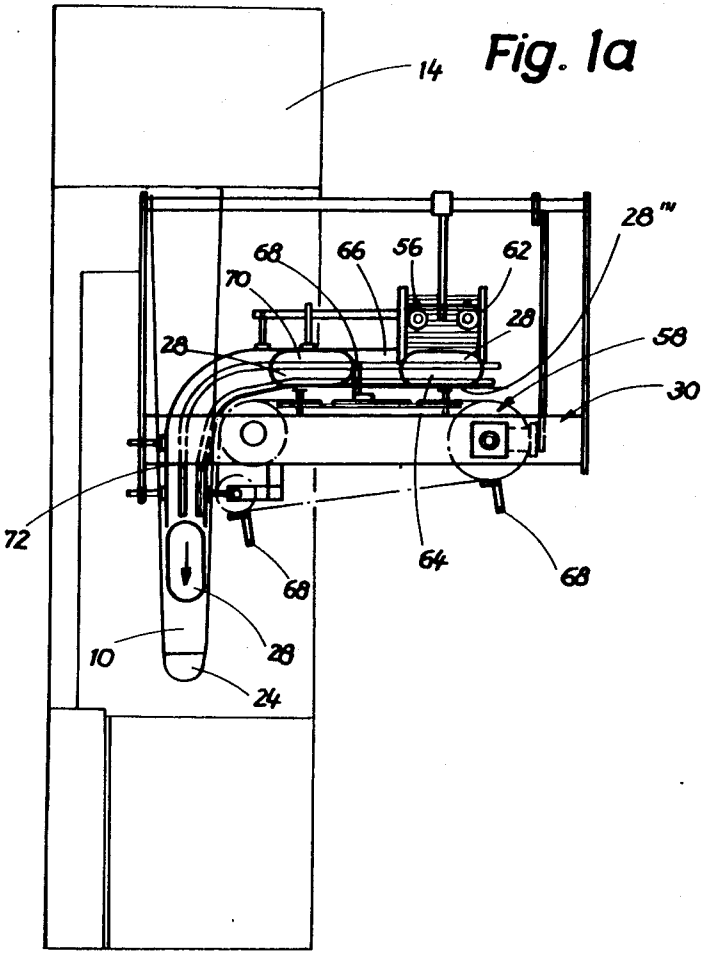
FIG. 1*a* is a diagrammatic front elevational view of a shaping machine for panty hose which is equipped in accordance with the present invention with an arrangement for introducing insert sheets into one leg of each panty hose.
Figure 1B:
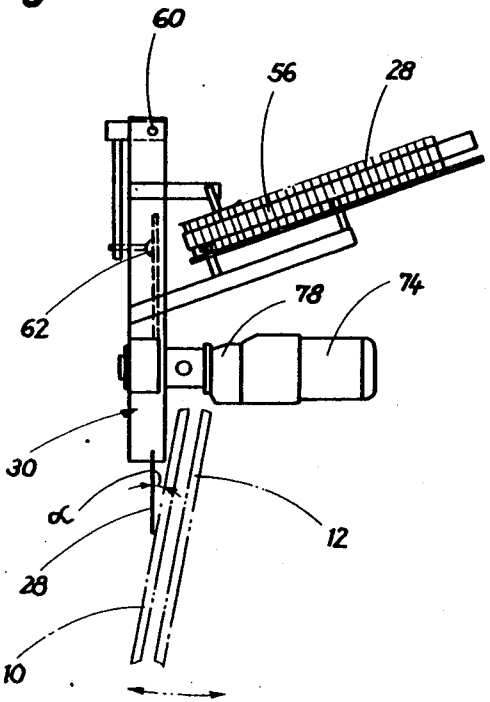
FIG. 1*b* is a diagrammatic partial side elevational view of the shaping machine of FIG. 1*a;*

Referring now to the drawing in detail, and first to FIGS. 1*a* and 1*b* thereof, it may be seen that there is illustrated therein a shaping machine which is constructed for the shaping of panty hose. This machine includes respective vertically extending elongated flat front and rear blades 10 and 12 which are mounted on a support 14 for pivoting about a transverse pivot axis, which is arranged at the upper regions of the blades 10 and 12 as considered in the illustrated position thereof, between a pulling-on and a pulling-off position, as well as with respect to one another.

Figure 3:
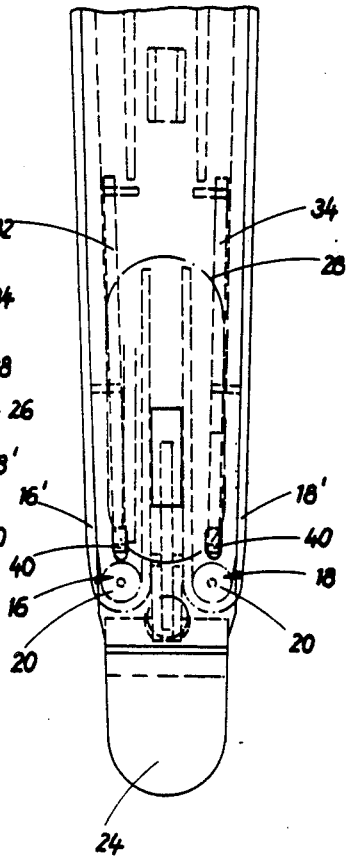
FIG. 3 is a view similar to FIG. 2 but with a wide side cover removed.

As illustrated in some detail particularly in FIG. 3 of the drawing, a belt drive 16 or 18, which is driven by a motor, extends along respectively associated longitudinal sides of the blades 10 and 12. Advantageously, each of the belt drives 16 or 18 includes a respective pair of belts 16' or 18' which are trained about respective reversing pulleys 20 that are arranged at the upper and the lower zones, only those reversing pulleys 20 which are situated at the lower zone having been shown. The reversing pulleys 20 are so arranged at the blades 10 and 12 that only one, as shown the outer, run of each of the belts 16' and 18' extends beyond the blades 10 and 12 in such a manner that the contour of this run defines the contour of the blades 10 and 12 at the longitudinal sides of the latter. The belt drives 16 and 18 are motor driven in such a manner that the two pairs of belts 16' and 18' move in opposite directions with respect to one another and at the same speed. Herein, the movement directions are so chosen that the outer runs of the belts 16' and 18' move, again as considered in the illustrated position of the blades 10 and 12, in the upward direction during the pulling-on operation, and in the downward direction during the pulling-off operation which will be discussed in more detail later.

In order to assure an unobjectionable shaping of the foot tip areas and pulling-off of the panty hose from the blades 10 and 12, there is provided at the back side of each of the blades 10 and 12 a shaping and ejecting plate 22 (see particularly FIG. 4) which is movable in the longitudinal direction of the blades 10 and 12 and which can be displaced during the pulling-off operation beyond a lower blade end portion 24 with attendant entrainment of the foot tip areas and transfer thereof to a non-illustrated roller pair.

Figure 2:
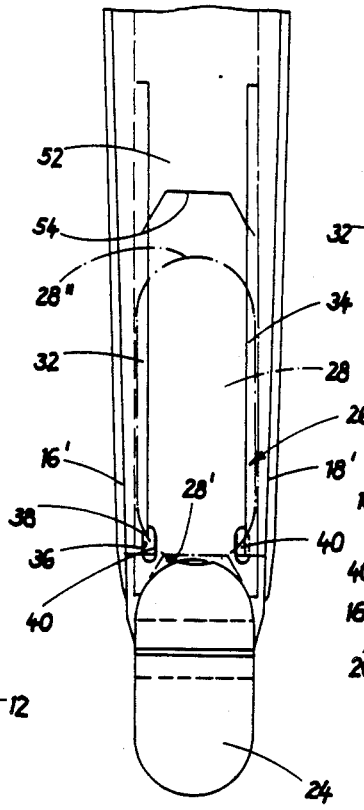
FIG. 2 is a front elevational view of a portion of a shaping blade of the machine of FIGS. 1*a* and 1*b*, at an enlarged scale.

The front blade 10 additionally includes a holding arrangement 26 for insert sheets 28 (see FIG. 2) which is supplied with respective insert sheets 28 by a sheet dispensing arrangement 30 that is arranged, as seen particularly in FIG. 1*a*, laterally next to the blades 10 and 12 on the machine support 14. Preferably, relatively stiff cardboard and/or synthetic plastic material punched-out formations are used as the insert sheets 28.

The holding arrangement 26 includes two guide rails 32 and 34 which are arranged at the wide side of the respective front blade 10 oppositely to one another and which serve for the receipt of the longitudinal lateral edge portions of the respective insert sheet 28. The holding arrangement 26 further includes an abutment which comprises two bosses 40 which penetrate through respective openings 36 provided in a wide side cover 38 (see particularly FIG. 2). The insert sheets 28 are introduced into the guide rails 32 and 34 from above at an acute angle $\alpha$, and they fall downwardly along the guide rails 32 and 34, until a respective leading edge 28' of the respective insert sheet 28 reaches and strikes against the bosses 40 which break the fall of this insert sheet 28.

Figure 4:
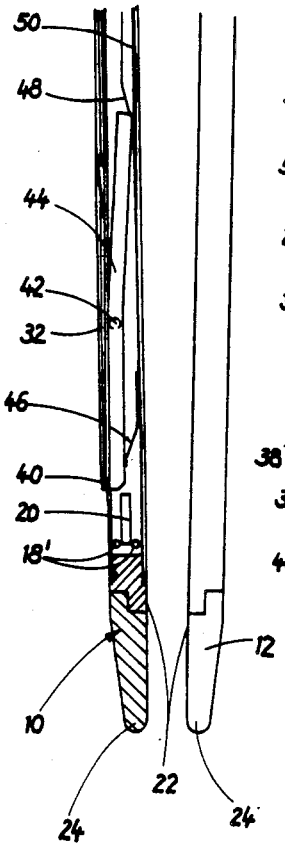
FIG. 4 is a partially sectioned side elevational view of the blade portion of FIGS. 2 and 3.

As shown particularly in FIG. 4 of the drawing, the abutment bosses 40 are so arranged at one end of a two-armed lever 44 which is mounted within the front blade 10 for pivoting about a transverse pivot axle 42 that they are retracted during the angular displacement of the lever 44 against the force of a spring 46 into the interior of the front blade 19 and thus free the end abutment for the ejection of the insert sheet 28. The actuation of the lever 44 is achieved by means of a wedge-shaped control cam 48 which is mounted on a control rod 50 which is arranged on the respective front blade 10 for shifting longitudinally thereof. Furthermore, an ejector slide 52 which is actuatable jointly with the control rod 50 is arranged at the outer side of the respective front blade 10 for longitudinal shifting. During the pulling-off operation, a leading edge 54 of the ejector slide 52 abuts against a trailing edge 28'' of the insert sheet 28 and ejects the insert sheet 28 out of the holding arrangement 26. The sequence of movements of the hose ejecting plates 22, of the control rod 50, and of the sheet ejector slide 52 is controlled during the pulling-off operation, for instance, by means of a non-illustrated control cam of a timing device, and these movements are so coordinated with one another that the insert sheet 28 is pulled off with the panty hose at a location within the one hose leg which is provided for the insert sheet and which remains always the same.

The sheet dispensing device 30 which is arranged on the machine support or frame 14 next to the blades 10 and 12 basically includes a stack magazine 56, a conveying arrangement 58 comprising an endless conveyor, as well as a suction arrangement 62 which is mounted for swinging to and fro about a horizontal axle 60 for individual withdrawal of the sheets 28 from the stack magazine 56 and the transfer of such withdrawn sheets 28 to the conveying arrangement 58. During this transfer, the sheets 28 are forwarded to an input location 64 of a horizontal conveying path 66 of the conveying arrangement 58 in such an alignment that they stand on one longitudinal edge 28''' thereof. Thereafter, the sheets 28 are displaced from the input location 64 by entraining bosses 68 of the endless conveyor of the conveying arrangement, which is constructed as a chain conveyor, into a waiting position 70 which is still situated on the horizontal conveying path 66. As considered in the conveying direction, the horizontal conveying path then gradually merges into a discharge path 72 which extends at an angle of about 90° with respect to the horizontal path 66 and downwardly from the latter and which opens at the aforementioned acute angle $\alpha$ into the input location of the holding device 26 at the blade 10. Herein, the lower end of the discharge path 72 is arranged at a small distance from the front blade 10, so that a free intermediate space is provided for the panty hose to be pulled up. The sheet 28 which is situated in its waiting position 70 is delivered during the next following via the discharge path 72 to the holding device 26. Herein, the delivery of the sheet 28 is accomplished in a free fall. In order to assure a reliable transfer of the respective sheet 28, the sheet 28 situated at the waiting location 70 is brought by the entraining bosses 68 of the chain conveyor of the conveying arrangement 58 to a sufficient discharge speed.

The suction arrangement 62 and the aforementioned endless conveyor of the conveying arrangement 58 are driven by a common motor 74, so that movement sequences that are coordinated with one another are achieved. A stepwise energization or release of the motor 74, or of a brake/coupling combination 78 which is connected with the motor 74, is achieved in a centrally controlled manner by means of a control device of the pulling-on and pulling-off arrangement which is not shown in any detail. In this manner, a new insert sheet or card 28 always reaches the holding device 26 when the pair of blades 10 and 18 is swung back again after the completion of the preceding pulling-off operation into the pulling-on position and is ready for the pulling-on of a new panty hose.

While the present invention has been described and illustrated herein as embodied in a specific construction of a panty hose forming arrangement, it is not limited to the details of this particular construction, since various modifications and structural changes are possible and contemplated by the present invention. Thus, the scope of the present invention is to be determined exclusively by the appended claims.

What is claimed is:

1. An arrangement for shaping hosiery articles, comprising in combination at least one elongated flat contoured blade having a wide side and two longitudinal sides;

two belt drives including respective driving belts which are guided within the contour of said blade and each arranged at one of said longitudinal sides of said blade;

means for driving said belt drives such that said driving belts thereof move in opposite directions and perform pulling-on and pulling-off operations on the hosiery articles;

means for supplying insert sheets sequentially prior to each pulling-on operation to a holding location arranged at said wide side of said blade; and holding means situated at said holding location within the contour of said blade for receiving the insert sheets from said supplying means and temporarily holding such insert sheets, including means for transferring the insert sheets during the respective pulling-off operations into the interiors of the respective hosiery articles, wherein said transferring means includes an ejector slide which is activated during the pulling-off operation, moves relative to said blade during the pulling-off operation at a speed corresponding to the pulling-off speed, and engages a trailing edge of the insert sheet as considered in the direction of ejection of said insert sheet, wherein said supply means includes sheet dispensing means for automatically introducing the insert sheets into holding means, said dispensing means including a magazine for the insert sheets, means for individually and sequentially withdrawing the insert sheets from the magazine, and conveying means receiving the individual insert sheets in sequence from said withdrawing means, and leading to said holding means of said blade at an acute angle with respect to said wide side of said blade.

2. The arrangement as defined in claim 1, wherein said holding means includes two guide rails which face one another, are open toward said supplying means, extend in the longitudinal direction of said blade, and overlap the longitudinal lateral edges of the respective insert sheets, and abutment means for the leading edge of the respective insert sheet, including at least one end abutment arranged at the ends of said guide rails and being retractable from the path of movement of the respective insert sheet during the pulling-off operation.

3. The arrangement as defined in claim 2, wherein said abutment means further includes a mounting lever pivotably mounted on said blade and carrying said end abutment at one end portion thereof, and means for urging said lever toward one end position thereof in which said end abutment projects into the path of movement of the leading edge of the respective insert sheet; and further comprising means for pivoting said lever during the pulling-off operation against the force of said urging means into another end position in which said end abutment is retracted from said path.

4. The arrangement as defined in claim 3, wherein said blade includes a wide side cover provided with at least one opening; and wherein said end abutment extends through said opening at least in said one end position of said lever.

5. The arrangement as defined in claim 3, wherein said lever is a two-armed lever.

6. The arrangement as defined in claim 3, wherein said transferring means includes an ejector slide; further comprising at least one hosiery ejection component slidably arranged on said blade; and wherein said pivoting means includes at least one control rod which is arranged within said blade and has a free end, a wedge-shaped control cam mounted on said free end of said control rod and engaging said one end portion of said lever, and means for moving said control rod jointly with said ejector slide and said hosiery ejection component.

7. The arrangement as defined in claim 6, wherein said lever with said end abutment and said control rod of said abutment means constitute one abutment unit, and wherein the abutment means further includes an additional abutment unit similar to said one abutment unit and arranged at a spacing transversely of said wide side of said blade therefrom, said moving means also moving said additional unit.

8. The arrangement as defined in claim 1, wherein said holding means has a substantially vertical orientation; and wherein said supplying means is so constructed as to supply the insert sheets into said holding means from above at an acute angle with respect to said wide side of said blade.

9. The arrangement as defined in claim 8, wherein said supplying means is operative for supplying the insert sheets into said holding means in free fall.

10. The arrangement as defined in claim 1, wherein said blade extends substantially vertically; wherein said dispensing means inclusive of said magazine is arranged at an upper region laterally next to said blade; wherein said conveying means includes an endless conveyor, a horizontal conveying path into which said withdrawing means delivers the insert sheets from above in a position in which the respective insert sheet stands on and is aligned on a longitudinal lateral edge thereof, and a discharging path into which said horizontal path gradually merges in the conveying direction and which extends from the horizontal path at an angle of about 90° and downwardly toward said holding means.

11. The arrangement as defined in claim 10, wherein said endless conveyor includes a conveyor chain.

12. The arrangement as defined in claim 10, wherein said endless conveyor includes at least two entraining bosses which engage the respective insert sheets at their trailing edges as considered in the conveying direction; and further comprising means for intermittently operating said endless conveyor jointly with said withdrawing means in synchronism with the pulling-on and pulling-off operations.

13. The arrangement as defined in claim 10, wherein said withdrawing means includes at least one suction element which is mounted for swinging to and fro between said magazine and an input location situated upwardly of said horizontal path and has suction applied thereto on an intermittent basis; and further comprising means for swinging said suction element in synchronism with the operation of said endless conveyor from a common drive.

14. The arrangement as defined in claim 10, wherein the end of said discharging path which is remote from said horizontal path is arranged at a distance which forms an intermediate space from the blade when the latter is in said pulling-on position thereof.

* * * * *